United States Patent [19]

Cano

[11] Patent Number: 5,020,160

[45] Date of Patent: Jun. 4, 1991

[54] PROTECTIVE DISPOSABLE HAND COVERING

[76] Inventor: Rolando M. Cano, 604 Solar Dr., Mission, Tex. 78572

[21] Appl. No.: 383,018

[22] Filed: Jul. 21, 1989

[51] Int. Cl.[5] ..... A41D 19/00

[52] U.S. Cl. ..... 2/159; 2/158; 2/161 R

[58] Field of Search ..... 2/159, 160, 161 R, 169, 2/243 B

[56] References Cited

U.S. PATENT DOCUMENTS

| | | | |
|---|---|---|---|
| 964,608 | 7/1910 | Chaddock et al. . | |
| 1,731,340 | 10/1929 | Lambert . | |
| 2,314,922 | 3/1943 | Chanut | 2/159 |
| 2,549,660 | 4/1951 | Buhl et al. | 2/159 |
| 2,710,409 | 6/1955 | Burandt | 2/160 |
| 2,755,566 | 7/1956 | Harrison | 36/138 X |
| 2,773,264 | 6/1953 | Nover | 2/159 |
| 2,976,540 | 3/1961 | Sutherland | 2/161 |
| 3,608,708 | 9/1971 | Storandt | 206/46 R |
| 4,034,853 | 7/1977 | Smith | 2/169 X |
| 4,117,609 | 10/1978 | Helt | 36/4 |
| 4,212,395 | 7/1980 | Korte | 206/628 X |
| 4,240,157 | 12/1980 | Peters | 2/161 R |
| 4,704,743 | 10/1987 | Thornell et al. | 2/159 |
| 4,745,635 | 5/1988 | Kinnear | 2/161 R |
| 4,791,682 | 12/1988 | Herr et al. | 2/160 |
| 4,858,821 | 8/1989 | Bickelhaupt | 206/631 X |
| 4,876,747 | 10/1989 | Coffey et al. | 2/161 RX |
| 4,918,755 | 4/1990 | Kinnear | 2/159 X |

FOREIGN PATENT DOCUMENTS

| | | | |
|---|---|---|---|
| 286000 | 2/1928 | United Kingdom | 2/160 |
| 2164540 | 3/1986 | United Kingdom | 2/159 |

*Primary Examiner*—Jimmy G. Foster
*Assistant Examiner*—BethAnne C. Cicconi
*Attorney, Agent, or Firm*—David L. Mossman

[57] ABSTRACT

A protective, disposable hand covering or mitt is provided having a tear line along at least a portion of the body thereof to provide controlled tearing and destruction of the glove to facilitate its removal. A mechanism such as a textured area, tab, hole, handle or the like may optionally be provided adjacent the tear line to assist in predictably tearing away the glove. The hand covering may be of plastic or paper or the like and should be of ambidextrous and somewhat oversized design, optionally with a flared cuff. Another optional feature is an inverted cuff to channel away any undesired liquid or other substance that may drip down the glove. Such hand coverings may find uses at self-service gasoline or fuel stations, in health care fields such as medicine and dentistry, in clean room manufacture, domestic cleaning and gardening and the like.

20 Claims, 2 Drawing Sheets

Fig.1
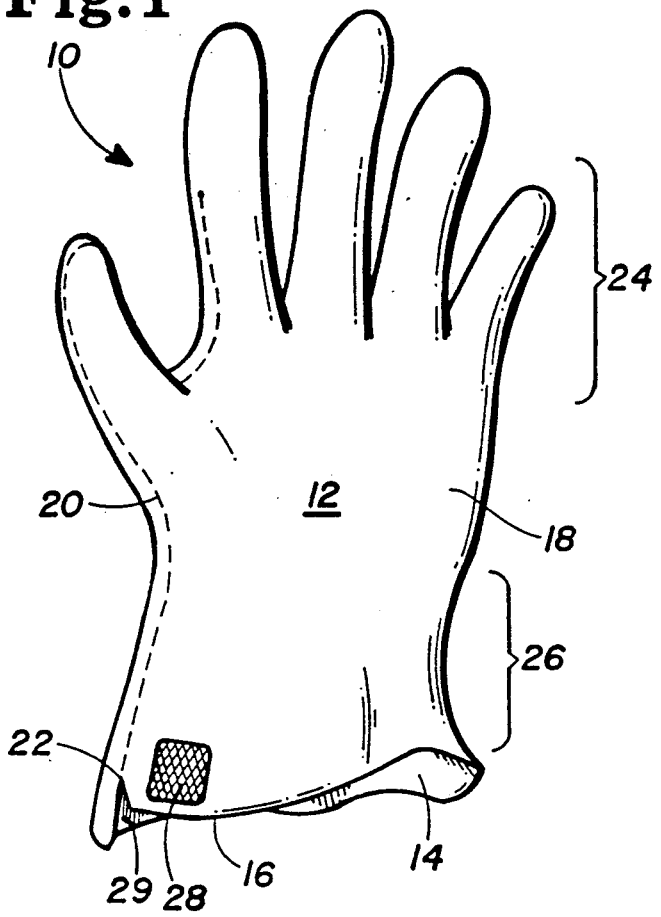
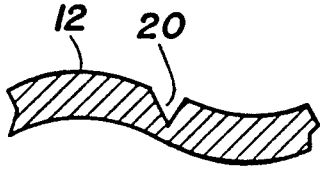
Fig.2
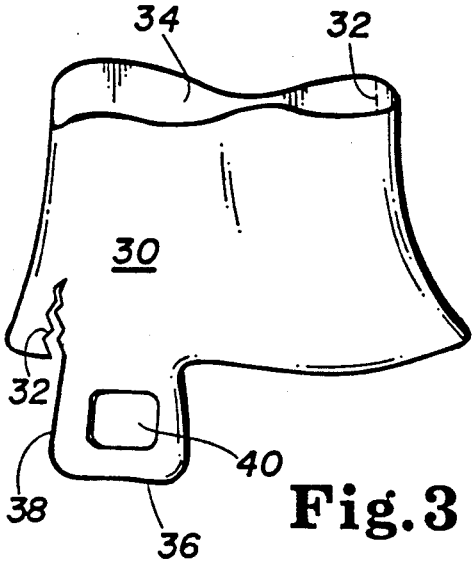
Fig.3
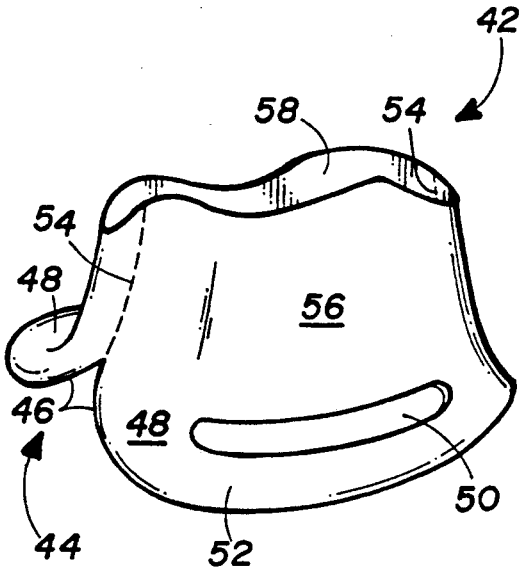
Fig.4

PROTECTIVE DISPOSABLE HAND COVERING

FIELD OF THE INVENTION

The invention relates to hand coverings, such as gloves or mitts, for human hands, and relates more particularly to gloves or mitts which are substantial enough to protect the hand from contact from substances such as grease, dirt, bacteria, gasoline and other chemicals and at the same time be disposable.

BACKGROUND OF THE INVENTION

The advent of self-service gasoline pumps, while convenient for the consumer and labor-saving for the service station attendant, has presented a relatively new problem. Gasoline and diesel fuel pump nozzles are typically oily, dirty and smell like the fuel dispensed through them. Consequently, the motorists who use self-service pumps get their hands dirty, and often fuel contaminates their hands when it splashes back at the end of dispensing. This problem has been attempted to be solved by placing a flap of plastic around the gasoline pump nozzle. However, the gasoline or diesel fuel still finds its way around the flap, or the fuel may leak out from the nozzle itself, for example, around the nozzle components and seals. In any event, despite the use of the conventional plastic flap or ring, the nozzle handle often remains wet, smelly and dirty.

This problem has not escaped the attention of the nation's inventors. U.S. Pat. No. 4,791,682 to Herr, et al. teaches a glove for attachment to a self-service fuel pump. However, such a configuration simply transfers the problem of the consumer getting his or her hands dirty from the nozzle handle to the accompanying glove to be universally used. That is, it is quite likely that the interior of such a glove may also become just as dirty, smelly and wet as the handle previously did. In fact, such a glove may aggravate the problem since it is readily appreciated that it would be difficult to clean the interior of such a permanently installed glove. Indeed, the consumer may be reluctant to use a glove which a multitude of others have already employed, with the possible build up of bacteria, perspiration and other moisture, such as rainwater, and perhaps even mold within the glove.

Peters in U.S. Pat. No. 4,240,157 addresses the problem in a different way, avoiding many of the problems of Herr, et al. by providing self-service gasoline glove is designed to travel with and be owned by the consumer. This glove is provided with a clip for securing it to a license plate or in a compartment during nonuse. However, the Peters glove has its own disadvantages, not the least of which is that the glove may be left behind in the manner of the well-known problem of leaving one's gasoline filler cap behind. Additionally, if the glove is secured to the outside of the vehicle, such as the license plate, it is apparent that the glove could easily become lost by being shaken loose during the sometimes sharp motions of the vehicle, or through theft. The Peters glove will also become dirty over time similarly to the Herr glove.

Further, there is U.S. Pat. No. 4,745,635 to Kinnear which teaches a disposable glove or mitt for self-service gasoline. By being disposable, this glove avoids the above-noted problems with the Herr and Peters patents. Interestingly, Kinnear fabricates his glove interior from blister- or bubble-containing plastic material, such as that conventionally used in the packing art. This provides a cushioned gripping surface with shock and thermal insulation. It is also discussed in this patent how the bubble surface may facilitate the insertion of the hand. However, it is apparent that this may be true only if the user is wearing no hand jewelry. The placement and removal of such a glove may be inhibited by the protruding jewelry often worn by women catching on the greatly increased surface area of the bubbles.

Disposable gloves or mitts are known, in general, such as shown by U.S. Pat. No. 1,731,340 which teaches a toilet tissue paper mitt. U.S. Pat. No. 2,976,540 teaches a plastic, disposable physician's examination hand mitt having a grasping tab. An oversized, protective covering for the hands is seen in U.S. Pat. No. 2,773,264.

Reusable, non-disposable gloves are known to be provided with mechanisms to separate portions of the gloves for various purposes. For example, U.S. Pat. No. 3,608,708 teaches a reusable applicator mitt which has seams that may be sealed by retaining members such as zippers, ribs and troughs, hook and pile (such as Velcro®) primarily to temporarily cover the replaceable applicator pad. A zipper is taught as the reversible seam of a glove with removable digits in U.S. Pat. No. 4,704,743; the thumb and forefinger being exposed to selectively increase dexterity, such as for snow skiing, while covering the balance of the hand. See also U.S. Pat. No. 2,549,660 which depicts a child's glove with a zipper along one edge. Other, more conventional gloves may be seen in U.S. Pat. Nos. 964,608 and 2,314,922.

Despite these many teachings, however, it would be desirable if a disposable, protective glove could be devised which would not have the attendant disadvantages of the three gloves discussed above specifically designed to aid the self-service dispensing of gasoline, diesel and other fuels.

SUMMARY OF THE INVENTION

Accordingly, it is an object of the present invention to provide a disposable hand covering for protecting a motorist's hand while dispensing gasoline or diesel fuel, as well as for other applications.

It is another object of the present invention to provide a protective, disposable hand covering that may be easily placed on and, in particular, removed from the human hand.

It is yet another object of the invention to provide a disposable, protective hand covering that can be worn on either hand and which is large enough for a wide range of hand sizes.

In carrying out these and other objects of the invention, there is provided, in one form, a protective, disposable hand covering having a hand covering body with a length, an interior space for receiving a human hand through an opening and an exterior surface. The hand covering is further provided with a tear line on the hand covering body extending from the opening at least partially along the length of the hand covering body.

BRIEF DESCRIPTION OF THE DRAWINGS

FIG. 1 is a three-quarters or perspective view of one aspect of the disposable, protective hand covering of the present invention;

FIG. 2 is a partial, expanded, cross-section view of the hand covering body showing one version of the tear line;

FIG. 3 is a partial view of the disposable, protective hand covering of the present invention with an alternate version of the means for grasping and tearing the hand covering;

FIG. 4 is a partial view of another aspect of the disposable, protective hand covering having another alternate version of the means for grasping and tearing the hand covering;

Figure 5:
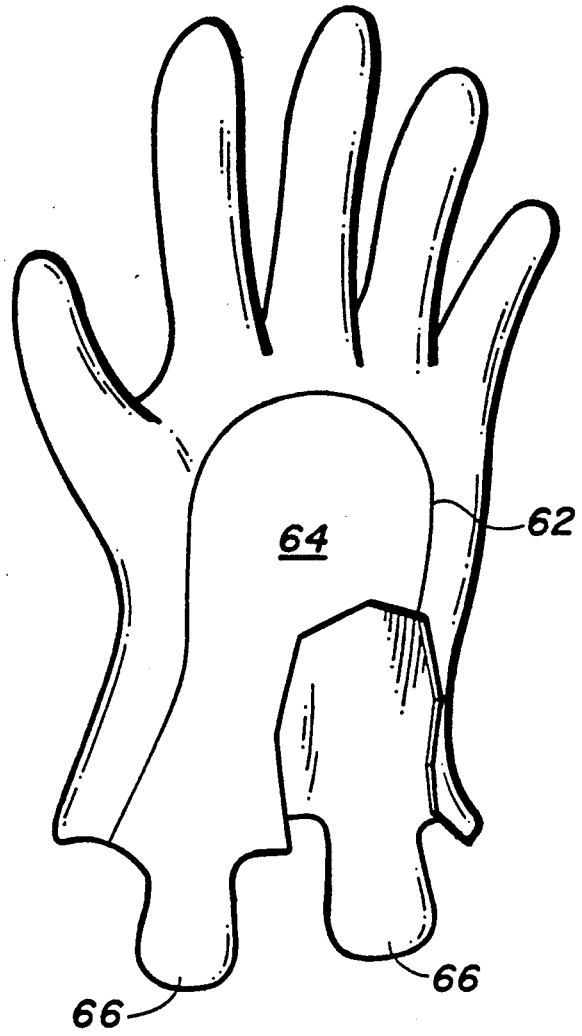
FIG. 5 is sectional, perspective view of yet another aspect of the disposable, protective hand covering with the tear line in an alternate configuration.

It will be appreciated that in some of the Figures certain features may not be in proportion and are exaggerated for clarity.

DETAILED DESCRIPTION OF THE INVENTION

The invention will now be described in more detail with reference to the various Figures. I have discovered a protective, disposable hand covering 10 having a hand covering body 12 of a certain length, with an interior space 14 for receiving a large variety of human hands without respect to left or right through an opening 16, and an exterior surface 18, bearing a tear line 20 on the hand covering body 12 extending from a point 22 on the opening 16 at least partially along the length of the hand covering body 12 as seen in FIG. 1. Disposable, protective hand covering 10 may be made available to motorists at self-service stations, and may also be sold in stores for purchase by motorists, as well as others, as will be described below. Hand covering 10 may be easily placed on either hand by the person fueling his or her vehicle, since hand covering 10 may be made oversized for the largest average hand size and may be made symmetrically along its edge plane 24 so as to fit either left or right hand. Additionally, hand covering 10 may be optionally provided with a flared cuff or wrist portion 26 to facilitate placing it on the hand.

It will be appreciated that hand covering 10 may be made from any material that would provide a barrier against dirt, grime, bacteria, chemicals such as oil, gasoline, diesel fuel, among other chemicals, and the like. Such materials may include, but are not limited to, plastic and paper, or combinations thereof. It is, of course, preferable that the material be inexpensive enough to provide a disposable hand covering that is suitable for discarding after one use.

When the motorist is through dispensing fuel, the hand covering 10 may be removed by literally tearing it off their hand along the tear line 20 and disposed of in the manner of known disposable hand coverings, without contaminating their free hand. The hand covering 10 thus gives the motorist fueling his or her vehicle complete protection on the hand used for holding the gasoline pump nozzle, or both hands, if desired. It will be appreciated, of course, that the hand covering 10 is not limited to use by motorists who prefer to pump their own fuel. Protective, disposable hand covering 10 may be advantageously used in any role where it is desired to protect the hands, such as areas dealing with health care as in the medical and dental fields, in arts that are frequently dirty and grimy such as automobile and machinery repair or gardening, or in areas where the barrier is desired to be directed in the other direction, as in the manufacture of sensitive electronics and integrated circuits in clean rooms, for example. In applications where more complete protection is needed, as in medical, dental, and clean room applications, it would be advantageous if the hand-covering were tight-fitting. A tight-fitting glove may also be appropriate in applications where the glove is worn for a relatively long period of time, rather than a very temporary application, such as in refueling, where a loose-fitting glove would be more desirable.

Tear line 20 will now be described in more detail with respect to FIG. 2 which depicts a portion of hand covering body 12 in cross-section. Obviously, tear line 20 must not completely pierce the hand covering body 12 so that the hand may be adequately protected from the dirt, chemicals, etc., for example. Thus, tear line 20 cannot consist of a line of perforations. Rather, tear line 20 may consist of a plurality of scores or grooves or a continuous groove or indentation in the hand covering body 12, as depicted in FIG. 2. FIGS. 1, 3, 4 and 6 depict discontinuous or dashed tear lines. FIG. 5, discussed below, depicts a continuous tear line. In the case of a dashed or dotted discontinuous tear line, there is no particular optimum length of line segment or diameter of dot, nor is there a preferred width of tear line. It is readily apparent that the exact design of the tear line will depend on the materials chosen and their tear resistant properties.

Figure 6:
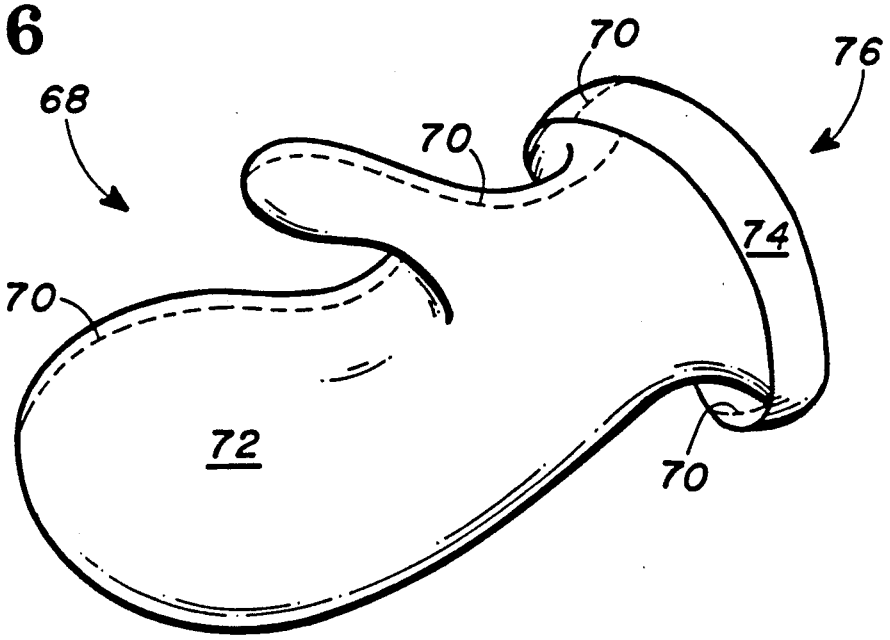
FIG. 6 is a three-quarters or perspective view of another aspect of the disposable, protective hand covering of the present invention in a mitt configuration having an optional inverted cuff.

What is important is that the tear line 20 be designed so that the hand covering 10 tears in a predictable fashion. In this way, the user will know in which direction to tear off the hand covering so that the contaminant on the exterior surface 18 of the hand covering 10 does not come into contact with either hand during the removal step. This does not mean, however, that the tear line 20 must be on the exterior surface 18 of the hand covering 10 as shown in FIGS. 1, 5 and 6. The tear line may be on the interior of the hand covering as depicted in FIG. 3, or may be on both the interior and exterior surfaces of the hand covering as seen in FIG. 4, as long the hand covering body is not perforated through. If the tear line is wholly on the interior of the hand covering, as in the FIG. 3 aspect, it may be prudent to mark the outside surface of the hand covering with a corresponding line so that the user can visually see where the tear will occur. Again, depending on the material used to make the hand covering, the tear line may perform better on one surface, interior or exterior, than the other. The process by which the gloves are manufactured may also affect this design decision.

Additionally, there is no overwhelmingly preferred configuration for the tear line 20. It may extend only partially across the length of the hand covering on the edge plane 24, as seen in FIG. 1. Edge plane 24 of glove 10 would be coincident with the major flat plane of the human hand when hand covering 10 is on the hand. That is, a gloved hand, when flat, would bear the hand covering 10 having plane 24 also in a flat orientation. Alternatively, the tear line may extend entirely across the edge plane terminating at the opening at a point opposite from whence it started, as depicted in FIGS. 3, 4 and 6. In another design variation, only a palm section could be outlined by the tear line, as shown in FIG. 5. More than one tear line may be provided in such a case, as in FIG. 5 (the other tear line being on the opposite side of the hand covering, and thus not visible) so that either a left- or right-handed person may tear the glove off from the side of the glove facing them. The tear line may also extend along the perimeter or main circumference of the glove, or may spiral around the glove over at least a portion of its length. It is also contemplated that multiple tear lines over the body of the hand covering or perhaps together in a group may prove satisfactory in certain applications. For example, the inventive hand covering would find utility for operators of heavy machinery where it is desired to keep one's hands clean, or to wear gloves for other reasons, but the use of a conventional glove would be dangerous if it caught on a moving mechanism that would pull the hand into physical risk. Using the tear-away hand covering of the present invention, the hand covering would be simply ripped off the operator's hand subjecting it to no risk.

It is understood, of course, that the objective of the tear lines is to aid in the removal of the hand covering quickly, easily and predictably. The tear lines do not have to be separated along their entire length either, when removed, since the objective is simply to peel the glove from the hand without contaminating the free hand. And although the sections or parts of the hand covering divided or partitioned by the tear lines cannot be specified closely, it will be appreciated that a hand covering with only one or a few tear lines will function best if the partitioned areas of the hand covering are proportionately large in comparison with the total hand covering area.

What the designers of other disposable gloves failed to understand, is that as long as the glove is disposable, the destruction of the glove in its removal is not important, and, in fact, should be used to advantage in providing further protection in predictable removal, and to make removal quick and easy. It will be understood that the hand covering of this invention, by tearing apart upon removing, is less likely to snag on jewelry than previous designs, since the glove surface is peeled perpendicularly from the hand rather than dragged over the hand in a direction parallel to the fingers.

It will be additionally appreciated that the tear line 10 need not have the V-shaped cross-section depicted in FIG. 2. The form of the groove or indentation is incidental and may be left up to the designer who must consider the materials and manufacturing process used.

Also shown in FIG. 1 is an optional feature of a mechanism 28 for grasping and tearing the hand covering 10 in the removal operation. Mechanism 28 may be a patch or area of roughened surface to assist grasping. Preferably, such mechanism 28, if used, should be present at or adjacent to the beginning of the tear line 20 at the hand covering 10 opening 16. In this way, the grasping and removal mechanism 28 can help start and direct the direction of the tear along tear line 20. Although a hand covering may be envisioned where the tear line 10 begins and such a mechanism 28, exists other than at the cuff edge or opening 16, it is preferred that tear line 20 begin at the opening 16 since it is likely that the cuff or area around the opening is the least likely surface to be soiled. In this way the opposite, possibly ungloved hand would not become dirty in the removal of the glove.

FIG. 1 also shows an alternate mechanism for grasping and tearing hand covering 10 in the form of flap 29 which is present on only one side of opening 16. Besides serving the function of a feature for grasping and tearing off glove 10, flap 29 will also assist in locating the opening 16 and guiding the hand into covering 10.

The length of the hand covering 10 is not critical, and may be specified for the particular application. For example, in some particularly dirty applications, it may be desirable to have the glove extend at least partway up the forearm.

Shown in FIG. 3 is another aspect of the hand covering 30 of this invention where the tear line 32 is on the interior 34 thereof. In this case the grasping and tearing mechanism is a tab 36. Tab 36 may have at least one side 38 adjacent to and contiguous with the tear line 32 such that pulling on tab 36 properly starts the tearing in a directed fashion, as depicted in FIG. 3. Tab 36 may be optionally provided with a hole 40 or other mechanism, such as a roughed surface, to facilitate its holding. The tab 36, in some aspects, may also serve to facilitate insertion of the hand into the glove, as will be described below with respect to FIG. 4.

Another variation of the hand covering 42 of this invention is seen in FIG. 4. In this version, the opening 44 can be thought of as having two opposing sides 46 where the tab extends across the width of one or both of the sides 46 to form a flap 48, which may optionally have a grasping hole 50 to form a handle 52 as the mechanism to grasp and easily remove the hand covering 42. If a handle 52 is present on each side of the hand covering 42, then the hand covering 42 may be truly ambidextrous, and the user will be presented with the removal handle 52 no matter how the hand covering 42 is place on the hand. In the embodiment of FIG. 4, it is also convenient to have the flaps 48 begin and end on opposing sides of the opening 44 coincident with the initial and ending points of tear line 54. In this version, a tear line 54 appears on both the exterior surface 56 and the interior surface 58 of hand covering 42. Flaps 48 serve to guide the hand as it is inserted into the glove. During removal, the free hand grasps one of flaps 48, or whatever mechanism is present for grasping and tearing hand covering 42, which may include holes 50 or handles 52.

Shown in FIG. 5 is yet another aspect of the invention as hand covering 60 having continuous tear lines 62 not along the edge of the hand covering 60, but rather around the palm section 64 of each side of an ambidextrous hand covering 60. It will be understood that the opposite side of hand covering 60 appears much as the side depicted in FIG. 5, an understanding which may apply to all the FIGS. of the drawings.

Continuous tear line 62 has tab 66 adjacent to it to facilitate its rending. The hand covering 60 may then come apart into three sections if the two tear lines were completely separated.

FIG. 6 depicts still another version of the invention as mitt 68 having a dashed tear line 70 over its exterior surface 72. Mitt 68 is provided with optional inverted or reversed cuff 74 which faces away from opening 76. Inverted cuff 74 serves to additionally protect the hand by channelling away any chemical or substance that would drip down the glove. Note that tear line 70 also extends over cuff 74. It will be appreciated that cuff 74 may serve as the grasping and removal mechanism, previously discussed, or may, in turn be provided with an area of roughened texture, a tab, a hole or a handle to facilitate removal.

Many modifications may be made in the disposable protective hand covering of the present invention without departing from the spirit and scope of the invention which are defined only by the appended claims. For example, it will be appreciated that the term "glove" herein is meant to encompass any form of covering for the hand, whether or not provision is made for separately covering one or more fingers as in a conventional glove, and thus includes configurations such as mitts, which may have no separate finger coverings or mittens which may provide only for separate thumb coverings, as depicted in FIG. 6. That is, the invention is not limited by the provision or lack thereof of fingers within the glove body. In another example of anticipated alternative hand coverings, it will be appreciated that a tab of size intermediate to tab 36 in FIG. 3 and flap 48 in FIG. 4 may be suitable for some applications.

I claim:

1. A protective, disposable hand covering comprising:

a hand covering body having a length, an interior space for receiving a human hand through an opening and an exterior surface; and a tear line on the hand covering body extending from the opening at least partially along the length of the hand covering body, where the tear line is at least one groove within, but not piercing the hand covering body, in the absence of a rip cord to cause tearing of the tear line.

2. The protective, disposable hand covering of claim 1 where the opening is provided with an inverted cuff facing away from the opening.

3. The protective, disposable hand covering of claim 1 where the tear line transverses the entire exterior surface of the hand covering and ends at a point on the opening different from where the tear line started.

4. The protective, disposable hand covering of claim 1 further comprising an edge along the body of the hand covering corresponding to a major plane of a human hand inserted in the hand covering, and further where the tear line parallels the edge.

5. The protective, disposable hand covering of claim 1 further comprising means for grasping and tearing the hand covering adjacent the tear line at the opening.

6. The protective, disposable hand covering of claim 5 where the means for grasping and tearing the hand covering is an outwardly protruding tab on the opening, where the tab has at least one side which is adjacent and contiguous with the tear line.

7. The protective, disposable hand covering of claim 6 where the tab is provided with a hole.

8. The protective, disposable hand covering of claim 6 where the opening has two opposing sides each having a width, and where the tab extends across the width of at least one side of the opening.

9. The protective, disposable hand covering of claim 8 where a tab extends across the width of both opposing sides.

10. A protective, disposable hand covering comprising:

a hand covering body having a length, an interior space for receiving a human hand through an opening and an exterior surface;

a tear line on the hand covering body extending from an initial point on the opening across the exterior surface to end at a point different from its initial point, where the tear line is at least one groove within, but not piercing the hand covering body, in the absence of a rip cord to cause tearing of the tear line; and an outwardly protruding tab on the opening, where the tab has at least one side which is adjacent and contiguous with the tear line.

11. The protective, disposable hand covering of claim 10 where the opening is provided with an inverted cuff facing away from the opening.

12. The protective, disposable hand covering of claim 10 further comprising an edge along the body of the hand covering corresponding to a major plane of a human hand inserted in the hand covering, and further where the tear line parallels the edge.

13. The protective, disposable hand covering of claim 10 where the tab is provided with a hole.

14. The protective, disposable hand covering of claim 10 where the opening has two opposing sides each having a width, and where the tab extends across the width of at least one side of the opening.

15. The protective, disposable hand covering of claim 14 where a tab extends across the width of both opposing sides.

16. A protective, disposable hand covering comprising:

a hand covering body having a length, an interior space for receiving a human hand through an opening and an exterior surface;

an inverted cuff on the opening facing away from the opening;

a tear line on the hand covering body extending from the inverted cuff at least partially along the length of the hand covering body, where the tear line is at least one groove within, but not piercing the hand covering body, in the absence of a rip cord to cause tearing of the tear line; and an outwardly protruding tab on the opening, where the tab has at least one side which is adjacent and contiguous with the tear line at the inverted cuff.

17. The protective, disposable hand covering of claim 16 further comprising an edge along the body of the hand covering corresponding to a major plane of a human hand inserted in the hand covering, and further where the tear line parallels the edge.

18. The protective, disposable hand covering of claim 16 where the tab is provided with a hole.

19. The protective, disposable hand covering of claim 16 where the inverted cuff at the opening has two opposing sides each having a width, and where the tab extends across the width of at least one side of the cuff.

20. The protective, disposable hand covering of claim 19 where a tab extends across the width of both opposing sides.

* * * * *